US007243925B2

(12) United States Patent
Lukoszek

(10) Patent No.: US 7,243,925 B2
(45) Date of Patent: Jul. 17, 2007

(54) TRUCK ASSEMBLIES FOR SKATEBOARDS

(75) Inventor: Benjamin Shane Lukoszek, Robina (AU)

(73) Assignee: System Boards Australia Pty Ltd, Robina, Queensland (AU)

( * ) Notice: Subject to any disclaimer, the term of this patent is extended or adjusted under 35 U.S.C. 154(b) by 205 days.

(21) Appl. No.: 10/525,560

(22) PCT Filed: Aug. 28, 2003

(86) PCT No.: PCT/AU03/01092

§ 371 (c)(1),
(2), (4) Date: Feb. 24, 2005

(87) PCT Pub. No.: WO2004/020059

PCT Pub. Date: Mar. 11, 2004

(65) Prior Publication Data

US 2006/0119062 A1 Jun. 8, 2006

Related U.S. Application Data

(63) Continuation-in-part of application No. 10/234,016, filed on Aug. 29, 2002, now abandoned.

(51) Int. Cl.
*A63C 1/00* (2006.01)

(52) U.S. Cl. ..... 280/11.28; 280/87.042

(58) Field of Classification Search ..... 280/11.27, 280/11.28, 87.042, 87.041, 87.03
See application file for complete search history.

(56) References Cited

U.S. PATENT DOCUMENTS 2,537,213 A 1/1951 Vault
3,331,612 A * 7/1967 Tietge ..... 280/11.28
3,618,970 A 11/1971 Frigaard
4,054,297 A * 10/1977 Solimine ..... 280/87.042
4,076,265 A 2/1978 Eash, II
4,109,925 A 8/1978 Williams
4,181,316 A * 1/1980 Brand et al. ..... 280/11.207
4,398,734 A 8/1983 Barnard
4,403,784 A * 9/1983 Gray ..... 280/11.28
4,886,297 A * 12/1989 Levine ..... 280/809
4,955,626 A 9/1990 Smith
5,022,668 A * 6/1991 Kenny ..... 280/7.14
5,114,166 A 5/1992 McCosker (Continued)

FOREIGN PATENT DOCUMENTS

DE 10053401 5/2002
EP 557872 9/1993
WO WO 01/60467 8/2001

OTHER PUBLICATIONS

"Ground Effect Truck", Peter Verdone Designs, 13 pages.

(Continued)

*Primary Examiner*—Christopher P. Ellis
*Assistant Examiner*—Brian Swenson
(74) *Attorney, Agent, or Firm*—Shoemaker and Mattare

(57) ABSTRACT

A skateboard truck assembly (10) having a main body (11) for mounting to the underside of a skateboard deck, an axle (24) carrying skateboard wheels (25) and mounted intermediate its opposite ends to the main body (11) via a rotatable steering adjustment body (20) for pivotal movement in a steering plane, the steering adjustment body (20) being mounted to the main body (11) for rotation about an axis extending transversely of the body (11) such that a change in the rotational position of the steering adjustment body (20) adjusts the pivot axis of the axle (24) and thus the steering characteristics of the truck assembly (10)

24 Claims, 6 Drawing Sheets

U.S. PATENT DOCUMENTS

| | | | | |
|---|---|---|---|---|
| 5,161,810 | A | 11/1992 | De Cesare | |
| 5,263,725 | A | 11/1993 | Gesmer et al. | |
| 5,330,214 | A | 7/1994 | Brooks | |
| 5,513,865 | A * | 5/1996 | Brooks et al. | 280/87.042 |
| 5,522,620 | A | 6/1996 | Pracas | |
| 5,997,018 | A * | 12/1999 | Lee | 280/87.042 |
| 6,224,076 | B1 | 5/2001 | Kent | |
| 6,279,930 | B1 * | 8/2001 | Chang et al. | 280/87.042 |
| 6,286,843 | B1 | 9/2001 | Lin | |
| 6,299,186 | B1 | 10/2001 | Kao | |
| 6,315,304 | B1 * | 11/2001 | Kirkland et al. | 280/11.28 |
| 6,318,739 | B1 | 11/2001 | Fehn | |
| 6,382,646 | B1 * | 5/2002 | Shaw | 280/87.041 |
| 6,520,516 | B2 | 2/2003 | Favorito | |
| 6,616,155 | B2 | 9/2003 | Tuan | |
| 6,761,369 | B1 * | 7/2004 | Anderson | 280/87.042 |
| 2002/0011713 | A1 | 1/2002 | Kirkland | |
| 2002/0089130 | A1 | 7/2002 | Cassell | |

OTHER PUBLICATIONS

"A Skateboard Truck Designed for Slalom and Downhill Race Use", Peter Verdone, http://www.peterverdone.com/groundeffect, 8 pages, Feb. 8, 2002.

"Deck Reviews", Norther California Downhill Skateboarding Association, http://www.ncdsa.com/gen tab 2.asp?CatID=1,4 pages, Jul. 28, 2002.

"Truck Reviews" Northern California Downhill Skateboarding Association, http://www.ncdsa.com/gen tab2.asp, 9.

"Deck Reviews" and "Truck Reviews", Northern California Downhill Skateboarding Association, http://www.ncdsa.com/search results.asp, 5 pages Mar. 8, 2002.

"Ground Effect Truck", Peter Verdone Designs, http://www.peterverdone.com/groundeffect.htm, 11 pages. Feb. 19, 2003.

"Deck Reviews" and "Truck Reviews", Northern California Downhill Skateboarding Association, http://www.ncdsa.com/search results.asp, 39 pages, Feb. 19, 2003.

* cited by examiner

TRUCK ASSEMBLIES FOR SKATEBOARDS

This application is a Continuation-In-Part of application Ser. No. 10/234,016 filed Aug. 29, 2002 now abandoned.

TECHNICAL FIELD

This invention relates to truck assemblies for skateboards or other similar vehicles and in particular to truck assemblies which enable steering characteristics of a skateboard or other similar vehicle to be varied.

BACKGROUND ART

Skateboards in many different designs have developed since introduction of the basic skateboard configuration. In the basic configuration, the skateboard comprises a deck having on its lower side front and rear truck assemblies, each of which supports opposite pairs of wheels on a transversely extending axle. The axles are mounted for pivotal movement about axes which extend at an obtuse angle to the plane of the skateboard deck and usually, the pivot axes of the axles of the front and rear truck assemblies are of an opposite inclination. Skateboard are therefore able to be steered by the rider leaning or shifting his or her weight to one side or other of the skateboard board thereby pivoting the deck in opposite directions relative to the longitudinal axis of the skateboard, this causing fore and aft pivotal movement of the truck axles in opposite directions. Usually the skateboard truck assemblies incorporate resilient pads which resist pivoting of the axle of the wheels and tend to return the axle and wheels to a neutral position.

More recently longboard skateboards have been introduced which include a deck of extended length. Skateboards of this type also incorporate truck assemblies however some difficulties are associated with steering of this type of board and maintaining their stability if conventional truck assemblies are used. It is also desirable to the enable adjustment of the steering characteristics of this type of skateboard to suit different applications. For this purpose it has been known to place an angled or wedge-shaped packer between the skateboard truck assembly and the underside of the skateboard deck to adjust the pivot axis of the truck assembly axle. This procedure however is obviously time-consuming as it involves removal of the truck assembly and then reassembling with the use of the angled packer between the truck assembly and board. A further disadvantage is that each time a different angle is required for the plane of operation of the axles of the skateboard wheels, a packer of a different angle is required.

Other truck assemblies have means for varying the type or characteristics of the resilient pads used to resist pivotal movement of the truck wheel axles such that for example a greater or lesser weight is required to be applied to one side or other of the skateboard deck obtain the same steering movement of the skateboard truck assemblies. These types of truck assemblies however have disadvantages as steering then becomes dependent on the weight applied and as a result control is compromised.

SUMMARY OF THE INVENTION

The present invention aims to provide an improved truck assembly particularly suited for use with longboard type skateboards but which is also suited to use with other forms of skateboard or other rideable vehicle. In particular aspect the present invention aims to provide a truck assembly in which the steering characteristics of the truck assembly can be selectively varied in a simple and effective manner. The present invention in a further aspect aims to provide a skateboard incorporating truck assemblies according to the present invention. In yet a further aspect, the present invention aims to provide and improved method and means for mounting a truck assembly to a deck of a skateboard or other rideable vehicle. Other objects and advantages of the invention will become apparent from the following description.

The present invention thus provides in a first preferred aspect, a truck assembly for a skateboard having a skateboard deck, said truck assembly having a main body adapted to be mounted to the underside of said skateboard deck, an axle for supporting a pair of skateboard wheels, means for mounting said axle to said main body in such a manner as to allow pivotal movement of said axle in opposite directions in a steering plane extending transversely of said main body and means for selectively adjusting said steering plane to vary the steering characteristics of said truck assembly.

The term "skateboard" as used throughout the specification includes conventional skateboards, longboard skateboards or any other rideable vehicle which uses truck assemblies.

Preferably pivot means mount the axle to the main body and define the plane of pivotal movement of the wheel axle. The pivot means is suitably provided intermediate opposite ends of the wheel axle and means are suitably provided for selectively adjusting the pivot means to adjust the plane of movement of the wheel axles. Typically the axis of pivot means lies in a plane extending longitudinally of and normal to the plane of the skateboard deck and the adjustment means adjusts the position of the axis of the pivot means in that plane.

In another aspect, the present invention provides a truck assembly for a skateboard having an elongated skateboard deck, said truck assembly having a main body adapted to be mounted to the underside of said skateboard deck, a wheel assembly having an axle and a pair of wheels rotatably mounted to opposite ends of said axle, pivot means intermediate said ends of said axle mounting said axle to said main body for pivotal movement about an axis extending substantially normally to said axle to thereby permit pivotal movement of said axle in or parallel to a plane normal to said axis, and means for selectively adjusting said pivot axis to vary the plane of movement of said axle whereby to change the steering characteristics of said truck assembly.

Preferably, pivot support means support the pivot means, the pivot support means being mounted to the main body for rotation about an axis extending transversely of the main body. The main body suitably has a longitudinal axis for longitudinal alignment with the skateboard deck and the pivot axis of the wheel axle is suitably adjustable in a plane passing through the longitudinal axis of said main body.

The pivot means in one preferred form may comprises trunnions or other pivot supports which extend to opposite sides of the wheel axle and means are provided for supporting the trunnions or pivot supports to the main body for rotation about the pivot axis of the pivot means to allow the axle of the wheels of the truck assembly to move in their plane of movement. Preferably, the trunnion support means are adjustable to enable variation of the pivot axis of the trunnions. Means may be provided for the unrestricted adjustment of the position of the trunnion support means and therefore unrestricted adjustment of the plane of pivotal movement of the axle of the truck assembly. Alternatively means may be provided for adjustment of the position of the trunnion support means and therefore plane of pivotal movement of the axle of the truck assembly to one of a number of discrete positions.

Preferably, the trunnion support means comprises an adjustable support boss mounted to the main body for rotational movement about an axis extending transversely of the main body and thus substantially normal to the longitudinal axis of the skateboard and parallel to the deck of the skateboard. The axle which supports the skateboard wheels is concentric to the axis of rotational movement of the boss when the axle is in a "neutral" position, that is a position where the truck assemblies are steering straight ahead. The trunnion support boss may be journalled to the main body or supported by any suitable bearing or bush arrangement to the main body. The support boss most suitably is mounted in a bore in the main body for rotation about an axis extending transversely of the main body and normal to the pivot axis of the axle.

The trunnions may typically be supported for rotation in bearings or bushes in the support boss. The support boss may be provided with an adjustment arm and the position of the adjustment arm is adjustable to thereby adjust the rotational position of the support boss and the pivot axis of the trunnions. In one form, a series of locating means may be provided to locate and define different positions of the adjustment arm. The locating means may for example be in the form of a plurality of stops, apertures, markers or indicators. The adjustment arm may include means which cooperate with, or which may be aligned with, a selected stop, aperture, marker or indicator to set or locate the position of the adjustment arm and boss. For example where the locating means are in the form of a plurality of apertures, the adjustment arm may include a pin which can locate in a selected aperture. The pin may be spring loaded to cooperate with a selected aperture to securely and positively locate and hold the arm in a selected position. The pin may have an enlarged head which facilitates its grasping and disengagement of the pin from a selected aperture. Most preferably, the arm extends generally radially relative to the axis of rotational movement of the boss and the locating means are arranged along an arc or curve on the main body of the truck assembly which is centered on the axis of rotational movement of the boss.

Biasing means are suitably provided for opposing pivotal movement of the axle of the truck assembly in its steering plane. The biasing means may be provided between the axle and main body. Preferably, the biasing means comprise springs which may comprise coiled springs or other elastic or resilient means. Most preferably, pairs of springs or resilient means are provided on both sides of the main body and extend between, and are connected to, the main body and axle. The springs or other resilient means suitably extend between and are connected to opposite ends of the main body and the axle.

Preferably, the truck assembly is adapted to be mounted detachably to the skateboard deck via a mounting means. The present invention thus provides in another preferred aspect a truck assembly for use with a skateboard having a skateboard deck, said truck assembly having a main body, and mounting means for mounting said main body to said skateboard deck, said mounting means comprising a mounting member adapted to be mounted directly to the underside of said skateboard deck, said mounting member having means for cooperation with said main body for mounting said truck assembly to said skateboard, or with a spacer for mounting said truck assembly via said spacer to said skateboard deck.

Preferably, the main body of the truck assembly is adapted for slidable engagement with the mounting member or spacer and the spacer is adapted for slidable engagement with the mounting member. The spacer may be any desired thickness and a series of spacers of different thicknesses may be provided for different applications.

Preferably, the mounting member and main body have complementary coupling means and the spacer has coupling means complementary to the coupling means of the main body and mounting member. The complementary coupling means may comprise a complementary rib or tongue/groove configuration which permits the main body, mounting member and spacer to be sidably interengaged. Releasable latch means may be provided for latching the main body to the spacer or mounting member and for latching the spacer to the mounting member.

The present invention in a further aspect provides a skateboard having an elongated skateboard deck and a pair of truck assemblies secured to the underside of said deck adjacent opposite ends of said deck, each said truck assembly having an axle supporting a pair of wheels at opposite ends thereof, and wherein said axle of at least one said truck assembly is mounted to said skateboard deck for pivotal movement in a steering plane extending transversely to the longitudinal axis of said skateboard deck to allow steering of said skateboard and there being provided means for selectively adjusting the inclination of said steering plane relative to said longitudinal axis of said skateboard deck to enable variation of the steering characteristics of said skateboard.

The steering plane is the plane in which or through which the axle moves during steering of the skateboard and suitably, the axle is supported for pivotal steering movement in the steering plane about a pivot axis defining the plane of pivotal movement of the axle, the pivot axis lying in a plane extending longitudilly of the skateboard deck and normal thereto. The means for selectively adjusting the plane of pivotal movement of the axle suitably comprises means for rotating the pivot axis in the longitudinally extending plane.

The at least one truck assembly suitably includes a main body mounted to the skateboard deck in longitudinal alignment with the longitudinal axis of the skateboard deck, and pivot support means are mounted to the main body for rotational movement about an axis extending transversely of the longitudinal axis, the pivot support means supporting the axle to the main body for pivotal movement about the pivot axis.

An adjustment arm is suitably provided for adjusting the rotational position of the pivot support means relative to the main body for adjusting the pivot axis of the axle, and locating means are suitably provided for locating the adjustment arm in a selected one of a series of spaced positions.

BRIEF DESCRIPTION OF THE DRAWINGS

In order that the invention may be more readily understood and put into practical effect, reference will now be made to the accompanying drawings which illustrate a preferred embodiment of the invention and wherein.

DETAILED DESCRIPTION OF THE PREFERRED EMBODIMENT

Figure 1:
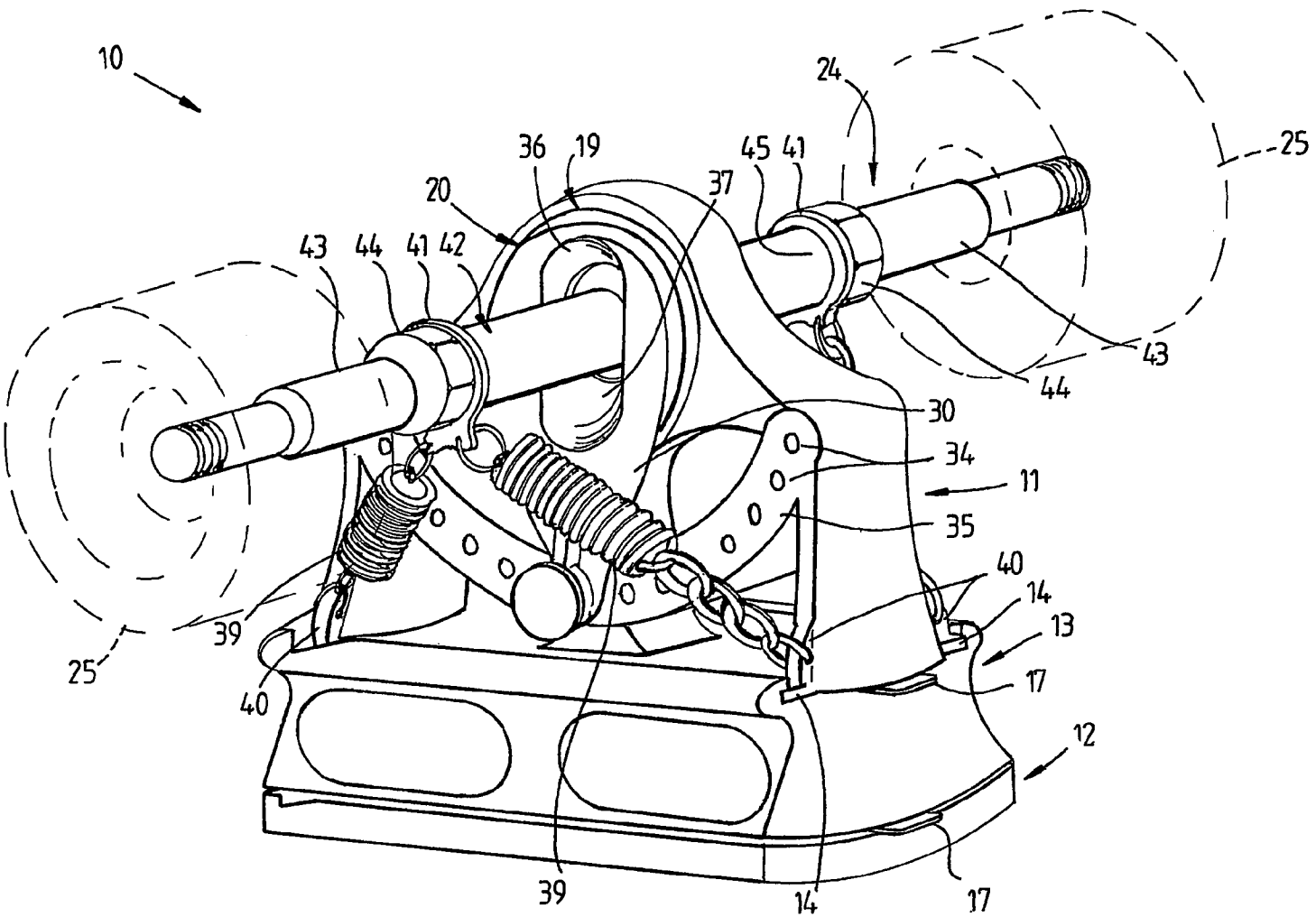
FIG. 1 is a perspective view of a truck assembly according to an embodiment of the invention.
Figure 2:
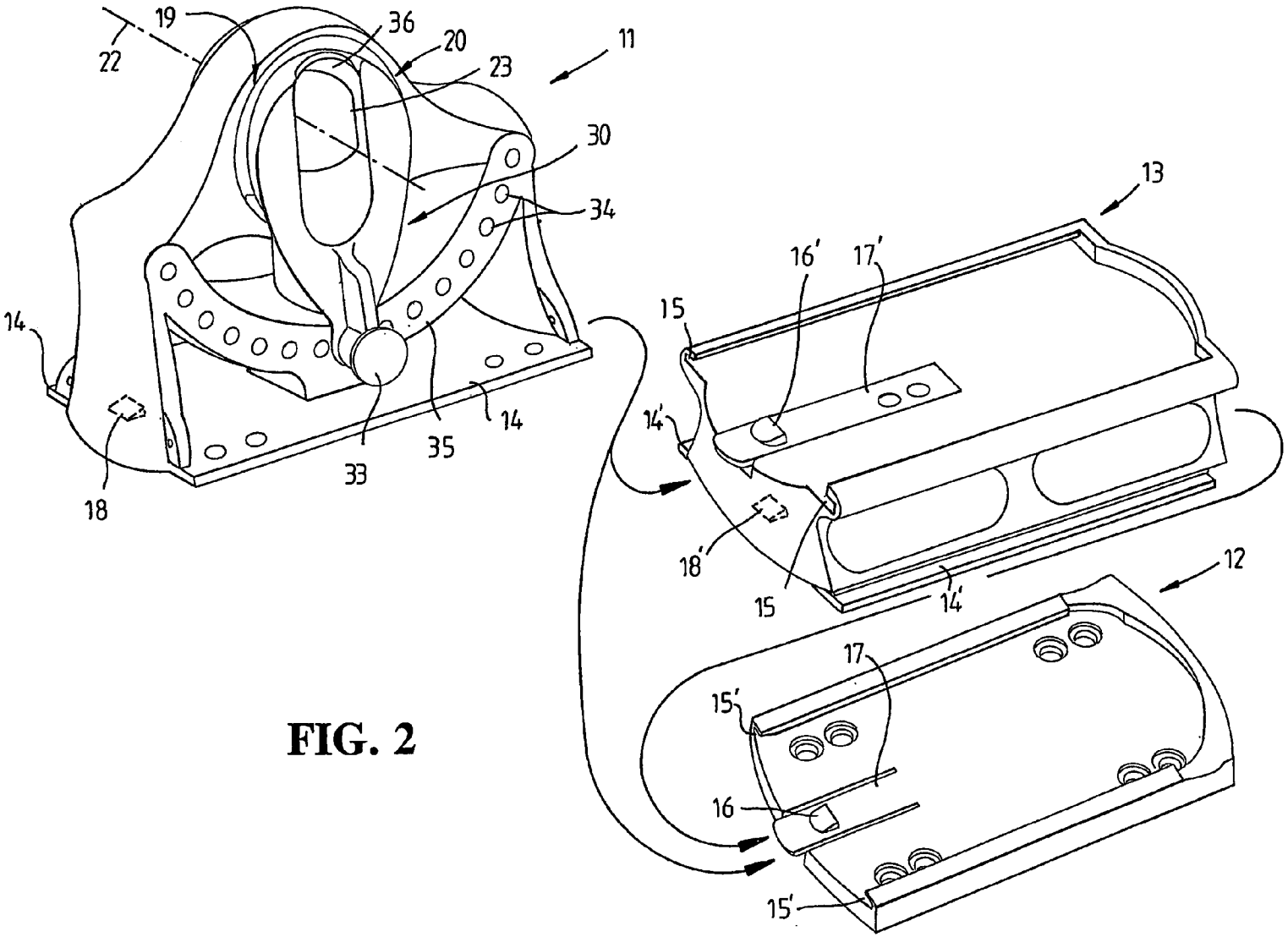
FIG. 2 illustrates in a dissembled view the truck body of the truck assembly and associated mounting block and spacer.

Referring to the drawings and firstly to FIGS. 1 and 2, there is illustrated a truck assembly 10 according to an embodiment of the invention primarily designed for use with longboard skateboards but which may be used with smaller size skateboards or any other similar rideable vehicle. The truck assembly 10 includes a main truck body 11 which is adapted to be mounted to the underside of the deck of a skateboard via a mounting block or member 12 which may be secured by bolts, screws or fasteners to the skateboard deck and with or without an intermediate spacer 13. Complementary coupling means are provided on the truck body 11, mounting block 12 and spacer 13 which allow them to be slidably interengaged. Thus the truck body 11 may be slidably engaged directly with the mounting block 12 or the truck body 11 may be slidably engaged with the spacer 13 and the spacer 13 slidably engaged with the mounting block 12. Thus spacers 13 of different thickness may be provided to enable different spacings of the truck body 11 from the skateboard deck.

The complementary coupling means comprise a tongue and groove type coupling comprising pairs of opposite parallel rails or edges 14 and 14' on the lower side of the truck body 11 and spacer 13 respectively and a pair of opposed parallel complementary grooves 15 and 15' on the upper side of the spacer 13 and mounting block 12. The ribs 14 and 14' and grooves 15 and 15' are at substantially the same lateral spacing such that the truck body 11 may be slid longitudinally onto the mounting block 12 or spacer 13 through the cooperation between the opposed ribs 14 or 14' and grooves 15 or 15' and similarly the spacer 13 may be slid longitudinally onto the mounting block 12 through the cooperation between the opposed ribs 14' and grooves 15'.

The truck body 11 is maintained in engagement with the mounting block 12 or spacer 13 by latching mechanisms comprising a latching member 16 and 16' on a spring or resilient finger 17 and 17' fixed to or integrally formed with the mounting block 12 or spacer 13. The latch members 16 and 16' are adapted to locate in a recess 18 on the underside of the truck body 11 and the latch member is adapted to located in a recess 18' on the underside of the spacer 13 to retain the body 11 to the block 12 or spacer 13, or spacer 13 to the mounting block 12. The body 11 may be detached from the block 12 or spacer 13 or the spacer 13 may be detached from the mounting block 12 by pushing the free end of the finger 17 or 17' downwardly to release the latch member 16 or 16' from the recess 18 or 18' to allow the truck body 11 to be slidably disengaged longitudinally from the mounting block 12 or spacer 13, or spacer 13 from the mounting block 12. Assembly is a reverse of the above except that the truck body 11 may be pushed onto the block 12 or spacer 13 until the latch member 16 or 16' under the influence of the spring finger 17 or 17' locates within or "snaps" into the recess 18 and similarly for engagement of the spacer 13 with the mounting block 12.

Figure 3:
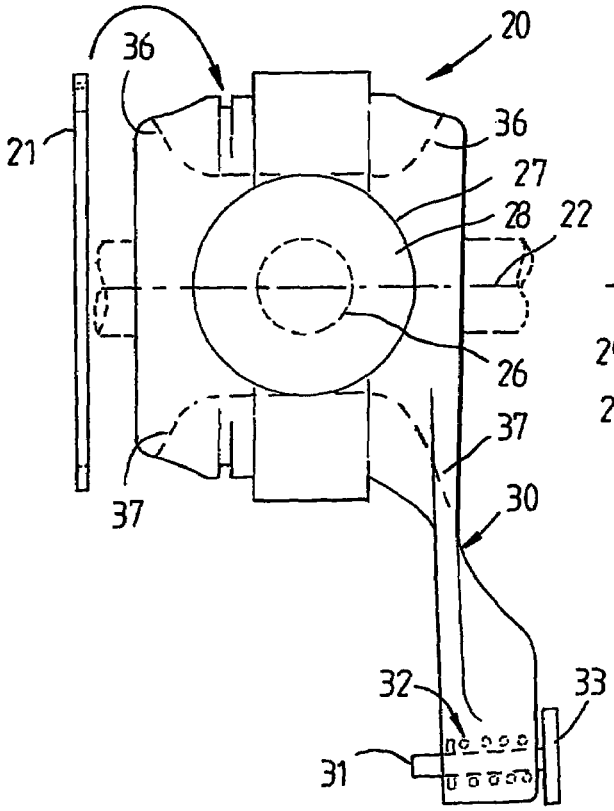
FIGS. 3 and 4 illustrate in side and front views, the steering adjustment body of the truck assembly.
Figure 4:
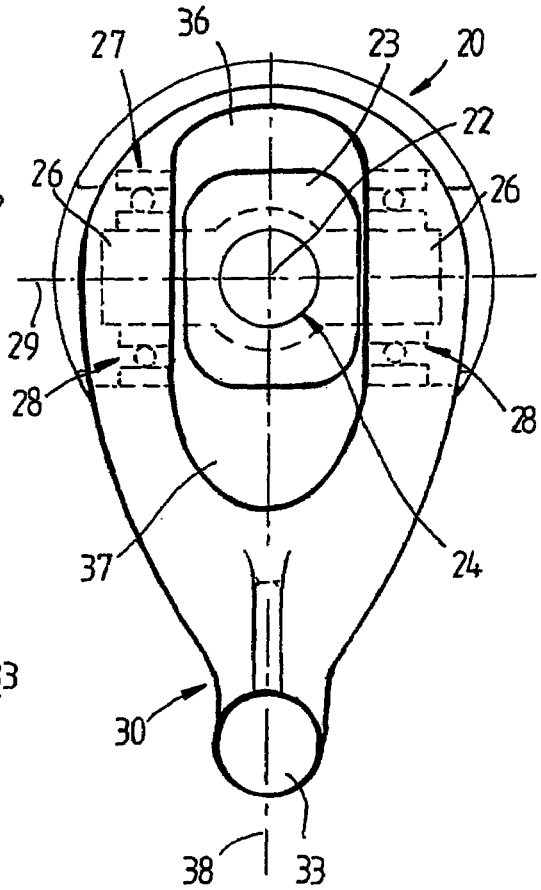

The truck body 11 includes a transversely extending bore 19 which is sized to accept a steering adjustment body or boss 20 (see also FIGS. 3 and 4) which is supported rotatably in the bore 19 by being inserted from one side thereof and which is retained by means of a circlip 21 on the opposite side such that the boss 20 is capable of rotation about the axis 22 of the bore 19, that axis 22 extending substantially normal to the longitudinal axis of the skateboard deck to which the truck assembly 10 is mounted. The boss 20 may be journalled directly in the bore 19 or supported therein for rotation by any suitable bearing arrangement. The boss 20 is also provided with a central bore 23 which is coaxial with the bore 19 of the body 11. The bore 23 is of a somewhat rectangular cross-sectional configuration and receives therethrough the main truck axle 24 which supports at opposite ends via bearings the wheels 25 of the truck assembly 10. The rectangular shape of the bore 23 accommodates pivotal movement of the truck axle 24 as described further below.

The truck axle 24 is mounted to the boss 20 by means of a trunnion arrangement comprising a pair of opposite trunnions 26 (see FIGS. 3 and 4) which are arranged intermediate the opposite ends of the axle 24 and which extend normal to the longitudinal axis of the axle 24. The trunnions 26 may be defined on opposite sides of a trunnion body through which the axle 24 passes. The trunnions 26 alternatively may be defined by a pin inserted into a bore which extends transversely through the axle 24 and projects on opposite sides thereof. In another arrangement, the trunnions 26 may be defined by a pair of pins which are provided on opposite sides of the axle 24 and interconnected for example by a threaded connection through the axle 24. Other arrangements however may be provided for defining the trunnions 26. The trunnions 26 are supported in opposite bores 27 in the boss 20 via bearings 28 such as roller or ball bearings or bushes so as to allow for smooth pivoting movement of the axle 24 about the axis 29 of the trunnions 26. As is apparent in FIG. 4, the trunnion axis 29 extends at right angles to the axis 22 of the bore 23 and defines a transverse pivot axis of the axle 24. The bores 27 may be closed on their outer sides by end caps. It will also be apparent that in the position of FIG. 1, the longitudinal axis of the axle 24 is coaxial with the axis 22 of the bore 19.

The orientation of the pivot axis 29 of the trunnions 26 can be adjusted by rotation of the boss 20 in the bore 19 of the truck body 11. To enable setting of position of the trunnion's pivot axis 29, an arm 30 which is integrally formed with the boss 20 extends radially from the boss 20. The free end of the arm 30 is provided with a spring loaded stop pin 31 which is normally urged by an internal spring 32 in the arm 30 to the position of FIG. 3 extending parallel to the axis 22 of the bore 19. The pin 31 is provided with a head 33 to facilitate grasping and retraction of the pin 31 against the force of the spring 32. The pin 31 may locate in one of a series of holes 34 provided at spaced apart positions along a curved member 35 of the body 11 which is centered on the rotational axis 22 of the boss 20. To change the rotational position of the boss 20 relative to the truck body 11, the pin 31 is retracted by grasping the pin head 33 and the arm 30 is then rotated in a desired direction to rotate the boss 20 and re-position the stop pin 31 in alignment with another one of the holes 34 after which the pin 31 may be released to locate within that hole 34 to positively hold the arm 30 and boss 20 in a set position. It will be apparent that during this movement, axle 24 remains concentric with the axis 22 of the bore 19.

The boss 20 is also provided with relief grooves 36 and 37 extending from, and on opposite sides of, the bore 23 and boss 20 and in alignment with the arm 30, the grooves 36 and 37 and the rectangular configuration of the bore 23 accommodating pivotal movement of the axle 24 in or parallel to a plane 38 (shown in dotted outline in FIG. 4) perpendicular to the pivot axis 29 of the trunnions 26. It will be appreciated that rotation of the steering boss 20 as described above will rotate the transverse pivot axis 29 of the axle 24 as defined by the trunnions 26 to thereby vary the orientation of the plane 38 along which the axle 24 may pivot.

To hold the axle 24 in a "neutral" position extending substantially at right angles to the truck body 11 and thus the longitudinal axis of the skateboard deck to which the truck assembly 10 is mounted, pairs of tension springs 39 are provided on opposite sides of the truck body 11 to extend between anchoring points 40 on the truck body 11 on either side of the axle 24, and a lug 41 mounted to the axle 24 at a position spaced outwardly from the body 11. The springs 39 provide a biasing force to resist pivotal movement of the axle 24 about the trunnion axis 29. The axle 24 preferably comprises a central part 42 which carries or is connected to the trunnions 26 and detachable opposite end parts 43 which carry the wheels 25. The end parts 43 have internally threaded cup like ends 44 which are adapted for threaded engagement with opposite externally threaded ends 45 of the central part 42. The spring mounting lugs 41 are captured and retained between the threaded ends 44 and 45. The described multi-part axle arrangement allows different length end parts 43 to be engaged with the central part 42 for different applications or for supporting wheels 25 of different sizes or configurations.

Figure 5:
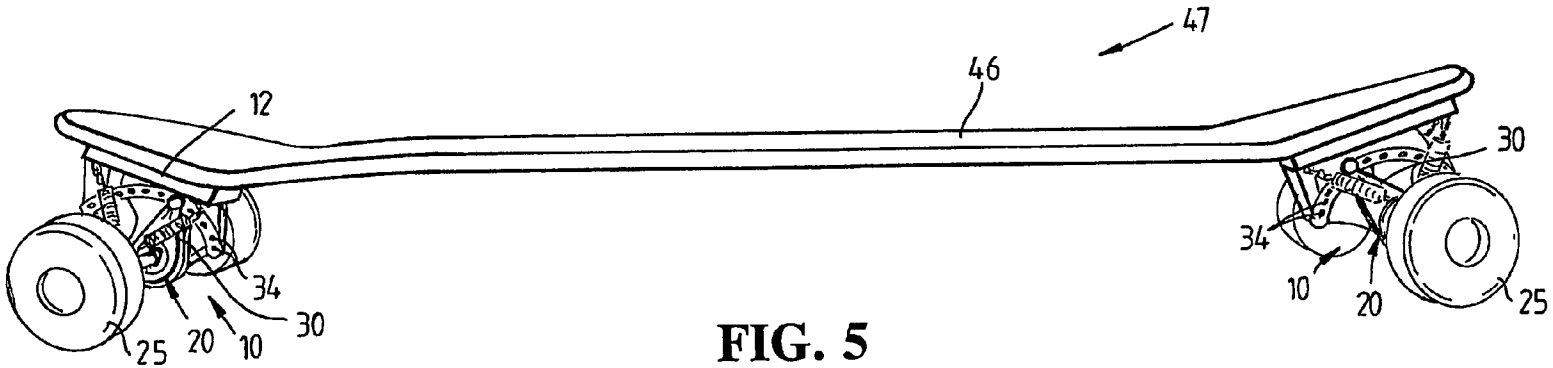
FIG. 5 illustrates a skateboard provided with a pair of truck assemblies according to an embodiment of the invention.
Figure 6:
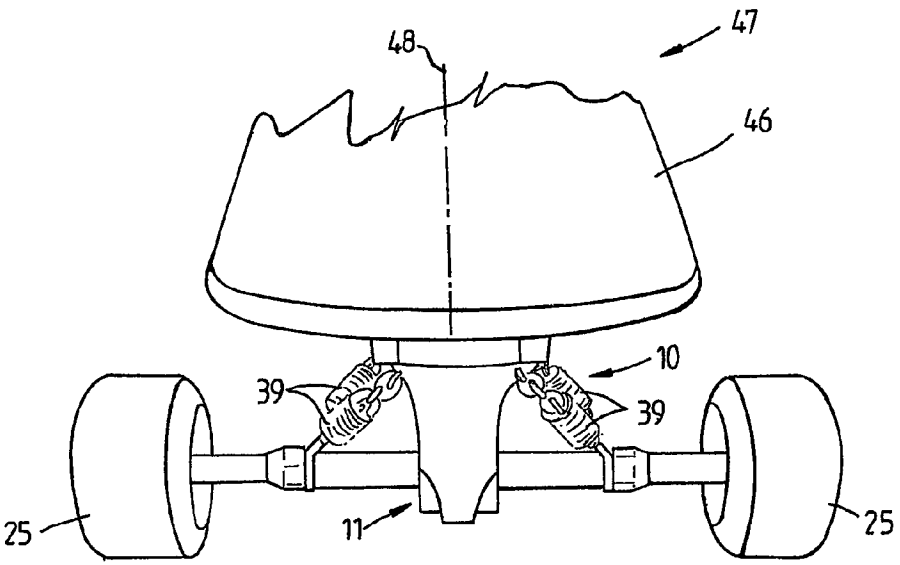
FIG. 6 illustrates portion of the skateboard of FIG. 5 from the front.

As shown in FIGS. 5 and 6, pairs of truck assemblies 10 are mounted at spaced apart fore and aft positions via respective mounting blocks 12 and spacers 13 (if required) to the underside of an elongated deck 46 to form a skateboard 47 typically a longboard type skateboard. The positions of the steering bosses 20 of each truck assembly 10 may then be varied depending upon the steering characteristics required in the skateboard 47. In the position shown in FIG. 1 and assuming that the truck assembly 11 is mounted to the deck 46 of the skateboard 47 such that the pivot axis 29 is parallel to the longitudinal axis 48 of the skateboard 47, pivotal movement of the skateboard deck 46 will not cause any steering movement of the truck assembly 10 as the axle 24 will pivot in a plane at right angles to the skateboard axis 48. Thus no fore and aft pivotal movement of the axle 24 results and thus no steering is achieved.

Figure 7:
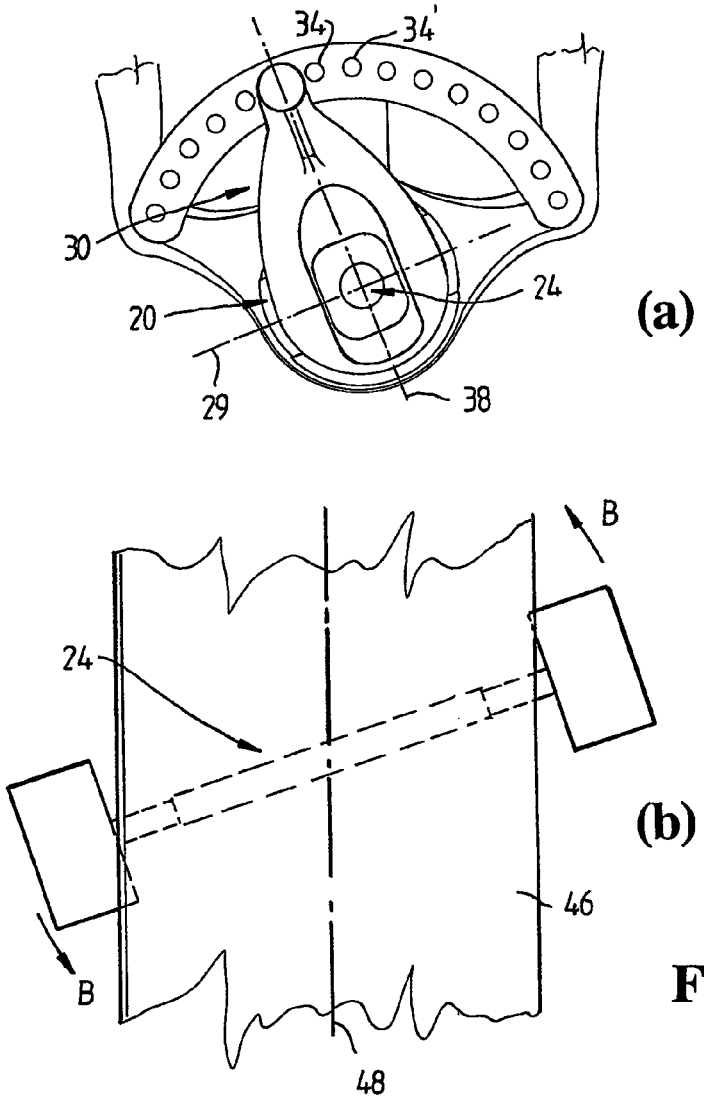
FIGS. 7(*a*), (*b*) and (*c*) illustrate respectively one position of the steering adjustment body and the steering effect achieved when the skateboard is tilted, shown schematically from the top and front.

Altering the plane of pivotal movement of the axle 24 by inclining the axis 29 of the trunnions 26 to the longitudinal axis 48 of the skateboard 47 will enable steering to be achieved. Thus if the arm 30 of the steering boss 20 is moved to a position where the stop pin 31 can locate in one of the holes 34 away from the central hole 34' as for example shown in FIG. 7(*a*), the pivot axis 29 of the turnnions 26 is accordingly pivoted such as to be inclined acutely to the longitudinal axis 48. Thus pivoting of the deck 46 as indicated by the arrows A in FIG. 7(*c*) during riding of the skateboard 47 by for example weight shifting will be translated into an anti-clockwise pivoting movement of the axle 24 as shown in FIG. 7(*b*) and as indicated by the arrows B along the inclined steering plane indicated at 38 in FIG. 7(*a*) and therefore steer the skateboard 47. Where the skateboard deck 46 is pivoted in the opposite direction, the axle 24 will pivot in the inclined plane 38 in a clockwise direction in to effect steering of the skateboard 47 in the opposite direction.

Figure 8:
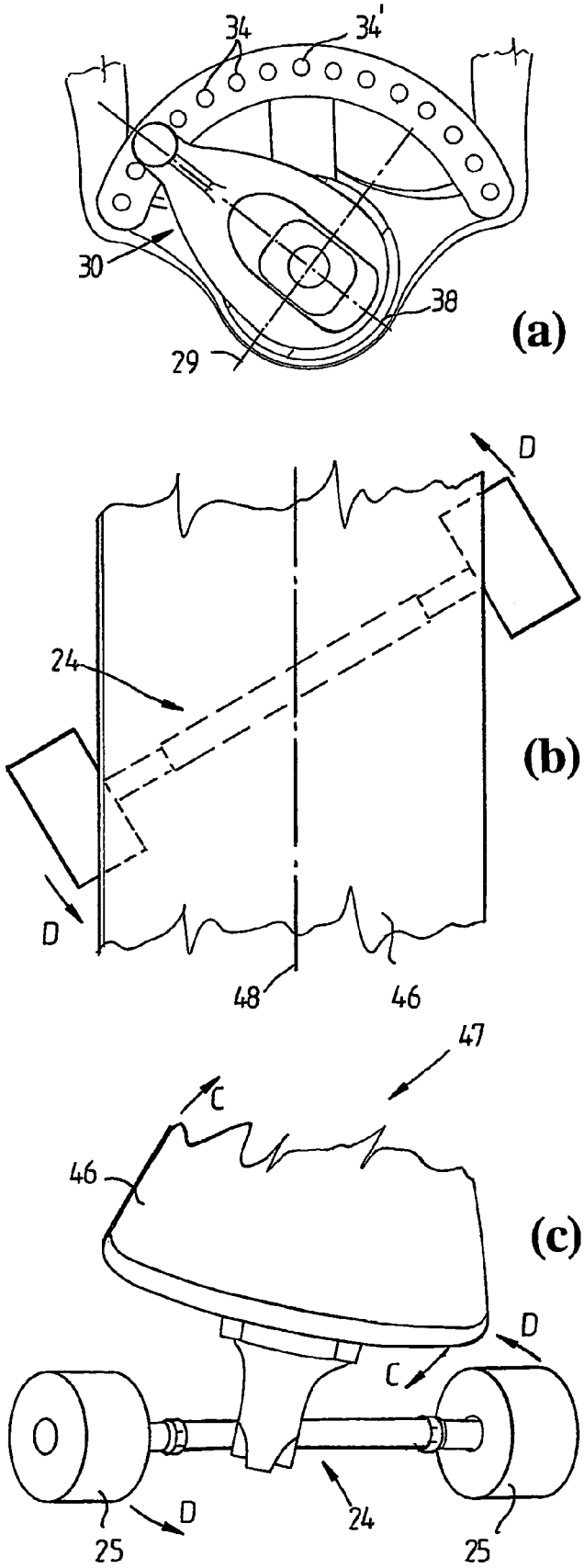
FIGS. 8(*a*), (*b*) and (*c*) illustrate respectively a second position of the steering adjustment body and the steering effect achieved when the skateboard is tilted shown schematically from the top and front.

If the arm 30 is further adjusted as shown in FIG. 8(*a*) to position the trunnion axis 29 at an increased angle to the longitudinal axis 48 of the skateboard 47, the possible plane 38 of movement of the axle 24 will, relative to the axis 48, become increasingly acute such that pivoting of the skateboard deck 46 as for example indicated by the arrows C in FIG. 8(*c*) will result in increased fore and anti-clockwise pivoting movement of the axle 24 and wheels 25 and thus sharper turning through a reduced turning circle as indicated by the arrows D.

Of course the steering effect of both the front and rear truck assemblies 10 may be selectively varied by simply readjusting the position of the arm 30 by retracting the stop pin 31 and repositioning the pin 31 in one of the holes 34 with movement of the pin 31 outwardly from the center position resulting in a reduced turning circle or a sharper steering effect with the same pivotal movement of the skateboard deck 46. The rider is therefore able in a simple and effective manner to selectively adjust the steering required for different circumstances or different applications.

In the skateboard 47 as illustrated in FIG. 5, it will be seen that the steering adjustment arms 30 of the truck assemblies 10 are angled in opposite directions such that when the deck 46 is pivoted about the longitudinal axis 48, the front and rear axles 24 will pivot in opposite directions. In some circumstances however it may be desirable to have only the front truck assembly 10 provide a steering function and thus the arm 30 of the rear truck assembly 10 in this instance is located in the central position as illustrated in FIG. 1 where the deck of the skateboard 47 is planar. In the skateboard 47 of FIG. 5 where opposite ends of the deck 46 are inclined upwardly, the arm 30 is adjusted such that it and the possible plane 38 of pivotal movement of the axle 24 is at right angles to the axis 48

The truck assemblies 10 of the invention may be applied to skateboard decks of many different configurations and various steering characteristics of the skateboard can be achieved by simply adjusting the adjustment arms 30 in the manner described. Further the handling characteristics can be varied by changing the spacers 13 or alternatively eliminating the spacers 13. It will be further appreciated that arrangements other than those described in the embodiment may be provided for supporting the axle 24 of the truck assembly 10 such that the angle of its possible plane of pivotal movement can be adjusted to adjust the steering characteristics of the truck assembly 10.

Whilst the above has been given by way of illustrative embodiment of the invention, all variations and modifications thereto as would be apparent to persons skilled in the art are deemed to fall within the broad scope and ambit of the invention as herein set forth.

The invention claimed is:

1. A truck assembly for use with a skateboard, the truck assembly comprising a main body adapted to be mounted to the underside of a deck of the skateboard;

an axle for supporting a pair of spaced wheels, said axle having a longitudinal axis;

a mount for a mounting the axle to the main body, said mount comprising a pivot permitting pivotal movement of the axle in a first plane to effect steering of the skateboard, the axis of pivotal movement of said axle lying in a second plane extending substantially longitudinally of and normal to a plane of the deck of the skateboard;

said pivot including a pair of pivot members extending on opposite sides of said axle and rotatably engaged with an adjustable support body rotatably mounted to the main body for movement about an axis extending substantially normal to a longitudinal axis of the skateboard and parallel to the deck of the skateboard, the axis of rotation of the support body and said longitudinal axis of said axle being substantially co-linear when said axle is in a non-pivoted position extending substantially parallel to the plane of the deck of the skateboard; and means for selectively adjusting the rotational position of the support body to adjust the axis of pivotal movement of the axle in the second plane and thereby the plane of pivotal movement of the axle to enable variation of steering characteristics of the skateboard.

2. The truck assembly of claim 1, wherein the pivot is located centrally intermediate opposite ends of the axle.

3. The truck assembly of claim 1, wherein said adjusting means comprises an adjustment arm for adjusting a rotational position of the support body and thereby adjusting the pivot axis of the pivot members.

4. The truck assembly of claim 3, wherein the adjustment arm is formed integrally with the support body.

5. The truck assembly of claim 3, wherein positioning of the adjustment arm is unrestricted.

6. The truck assembly of claim 3, further comprising a locator for locating the adjustment arm in a selected one of a series of fixed positions.

7. The truck assembly of claim 6, wherein the locator comprises one or more of a stop, an aperture, a marker, and an indicator.

8. The truck assembly of claim 7, wherein the locator comprises a plurality of apertures adapted to co-operate with a pin to locate the arm in a selected position.

9. The truck assembly of claim 8, wherein the plurality of apertures are distributed in an arc on the main body and wherein the pin is carried by the arm.

10. The truck assembly of claim 1, further comprising biasing means adapted to oppose reciprocal pivotal movement of the axle.

11. The truck assembly of claim 10, wherein the biasing means comprises springs.

12. The truck assembly of claim 11, wherein the springs comprise two pairs of coiled springs, each pair located on a respective side of the main body and interconnecting the axle and the main body.

13. The truck assembly of claim 1, further comprising a mounting member for detachably mounting the truck assembly to a skateboard deck.

14. The truck assembly of claim 13, further comprising at least one spacer detachably engageable between the main body and the mounting member.

15. The truck assembly of claim 14, wherein a plurality of spacers is provided, each spacer being of a different thickness to each other spacer.

16. A skateboard comprising:

a deck;

a pair of track assemblies secured to the underside of the deck, each truck assembly comprising a main body mounted to the underside of the deck;

an axle supporting a pair of spaced wheels, said axle having a longitudinal axis;

a mount mounting the axle to the main body, said mount comprising a pivot permitting pivotal movement of the axle in a first plane to effect steering of the skateboard, the axis of pivotal movement of said axle lying in a second plane extending substantially longitudinally of and normal to a plane of the deck;

said pivot including a pair of pivot members extending on opposite sides of said axle and rotatably engaged with an adjustable support body rotatably mounted to the main body for movement about an axis extending substantially normal to a longitudinal axis of the skateboard and parallel to the deck of the skateboard, the axis of rotation of the support body and said longitudinal axis of said axle being substantially co-linear when said axle is in a non-pivoted position extending substantially parallel to the plane of the deck of the skateboard; and means for selectively adjusting the rotational position of the body to adjust the axis of pivotal movement of the axle in the second plane and thereby the plane of pivotal movement of the axle to enable variation of steering characteristics of the skateboard.

17. The skateboard of claim 16, and including a first mounting member adapted to be mounted directly to the underside of the deck of the skateboard, the first mounting member having a coupling part adapted for at least one of cooperating with the truck assembly to mount the truck assembly to the skateboard and cooperating with at least one spacer for mounting the truck assembly and at least one spacer to the skateboard.

18. The skateboard of claim 17, wherein the truck assembly, the spacer, and the mounting member are each slideably engageable with the others.

19. The skateboard of claim 18, wherein the truck assembly, the spacer, and the mounting member are slidably engageable through rib and complementary groove couplers.

20. The skateboard of claim 18, further comprising a releasable latch for latching together two of the mounting member, the truck assembly, and the at least one spacer.

21. The skateboard of claim 18, further including at least one extension piece screw threadably engageable with the axle to thereby extend the axle and space the wheels further apart.

22. A truck assembly for use with a skateboard, the truck assembly comprising a main body adapted to be mounted to the underside of a deck of the skateboard;

an axle for supporting a pair of spaced wheels, said axle having a longitudinal axis;

a mount for a mounting the axle to the main body, said mount comprising a pivot permitting pivotal movement of the axle in a first plane to effect steering of the skateboard, the axis of pivotal movement of said axle lying in a second plane extending substantially longitudinally of and normal to a plane of the deck of the skateboard;

said pivot including a pair of pivot members extending on opposite sides of said axle and rotatably engaged with an adjustable support body rotatably mounted to the main body for movement about an axis extending substantially normal to a longitudinal axis of the skateboard and parallel to the deck of the skateboard, and an adjustment arm for selectively adjusting the rotational position of the support body to adjust the axis of pivotal movement of the axle in said second plane and thereby the plane of pivotal movement of the axle to enable variation of steering characteristics of the skateboard, said adjustment arm being fixed for movement with said support body and a locator for locating the adjustment arm in a selected one of a plurality of fixed positions.

23. The truck assembly of claim 22, wherein the locator comprises a plurality of apertures adapted to co-operate with a pin to locate the arm in a selected position.

24. The truck assembly of claim 23, wherein the plurality of apertures are distributed in an arc on the main body and the pin comprises a spring loaded pin on said arm.

* * * * *